US009975357B2

(12) United States Patent
Suda et al.

(10) Patent No.: US 9,975,357 B2
(45) Date of Patent: May 22, 2018

(54) PRINTING PRESS

(71) Applicant: Komori Corporation, Tokyo (JP)

(72) Inventors: Hiroyuki Suda, Yamagata (JP); Hayato Kondo, Ibaraki (JP); Toshinori Kubo, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days. days.

(21) Appl. No.: 15/169,481

(22) Filed: May 31, 2016

(65) Prior Publication Data

US 2016/0355032 A1 Dec. 8, 2016

(30) Foreign Application Priority Data

Jun. 5, 2015 (JP) ..... 2015-114515

(51) Int. Cl.

| | |
|---|---|
| ***B41J 2/01*** | (2006.01) |
| ***B41J 11/00*** | (2006.01) |
| ***B41F 31/00*** | (2006.01) |
| ***B41J 13/22*** | (2006.01) |

(52) U.S. Cl.

CPC ..... *B41J 11/0085* (2013.01); *B41F 31/001* (2013.01); *B41J 2/01* (2013.01); *B41J 13/226* (2013.01)

(58) Field of Classification Search

CPC ..... B41J 11/0085; B41J 2/01; B41J 13/266; B41J 13/226

See application file for complete search history.

(56) References Cited

U.S. PATENT DOCUMENTS 3,536,003 A * 10/1970 Oderman ..... B41F 27/1212 101/415.1
6,209,867 B1 * 4/2001 Madsen ..... B41J 11/0025 271/183

(Continued)

FOREIGN PATENT DOCUMENTS

CN 102343713 2/2012
CN 103253007 8/2013

(Continued)

OTHER PUBLICATIONS

Search Report in European Application No. 16001262.1 dated Oct. 26, 2016. 9 pages.

(Continued)

*Primary Examiner* — Julian Huffman
*Assistant Examiner* — Michael Konczal
(74) *Attorney, Agent, or Firm* — Womble Bond Dickinson (US) LLP

(57) ABSTRACT

A printing cylinder includes a plurality of suction chambers and a masking sheet configured to cover the suction chambers. The masking sheet includes a non-sucking portion which protrudes from the boundary of the suction chambers toward the inside of the suction chambers. A number of through holes are formed in a portion except for the non-sucking portion in the masking sheet. The non-sucking portion exists between the sheet to be printed and the boundary of the suction chamber to be used and the suction chamber not to be used. This can prevent an ink mist from adhering to the printing cylinder.

7 Claims, 5 Drawing Sheets

(56) References Cited

U.S. PATENT DOCUMENTS

| | | | | |
|---|---|---|---|---|
| 6,254,090 | B1 * | 7/2001 | Rhodes | B41J 11/0085 271/265.01 |
| 2002/0067403 | A1 * | 6/2002 | Smith | B41J 11/007 347/104 |
| 2003/0015111 | A1 | 1/2003 | Rizika et al. | |
| 2010/0238249 | A1 * | 9/2010 | Panides | B41J 11/007 347/104 |

FOREIGN PATENT DOCUMENTS

| | | | | |
|---|---|---|---|---|
| EP | 2 409 845 | A1 | 1/2012 | |
| EP | 2409845 | A1 * | 1/2012 | B41J 11/0085 |
| EP | 2 878 449 | A1 | 6/2015 | |
| JP | 2013-240997 | A | 12/2013 | |

OTHER PUBLICATIONS

"First office action," CN Application No. 201610389718.3 (Feb. 28, 2018).

* cited by examiner

PRINTING PRESS

BACKGROUND OF THE INVENTION

The present invention relates to a printing press including a printing cylinder for sucking and conveying a sheet.

Since a digital printing press including inkjet heads needs to keep a constant distance between an inkjet head surface and a sheet, it includes a printing cylinder for sucking and conveying the sheet. For example, Japanese Patent Laid-Open No. 2013-240997 (literature 1) discloses an example of this type of printing cylinder. The printing cylinder disclosed in literature 1 includes a suction area where a number of suction holes are formed. This suction area is divided into three suction portions in the sheet convey direction. Each suction portion can switch between an air suction state and an air suction stop state. Therefore, it is possible to use only a suction portion corresponding to the size of a sheet to be printed, and stop air suction in an unnecessary suction portion where no sheet is sucked.

An inkjet head used for a digital printing press readily generates an ink mist due to its principle. The ink mist is sucked near suction holes and tends to be accumulated around the suction holes. If the suction holes are clogged with the accumulated ink mist, not only a sheet sucking failure occurs but also the ink mist may contaminate a sheet. Note that an ink mist may be generated in an offset printing press which uses no inkjet head.

In the printing cylinder disclosed in literature 1, an ink mist generated by an inkjet head may adhere around suction holes. This is because part of the suction portion is exposed outside the sheet. This problem can be solved by dividing the suction area into a larger number of suction portions. However, there are various sizes of sheets to be printed, dividing the suction area to cope with all the sizes of sheets unwantedly complicates the structure and control.

SUMMARY OF THE INVENTION

It is an object of the present invention to provide a printing press which includes a printing cylinder for sucking and conveying a sheet but can prevent an ink mist from adhering to the printing cylinder with a simple structure.

In order to achieve the above object of the present invention, there is provided a printing press including a printing cylinder configured to suck and convey a sheet as a printing product, and including a plurality of suction chambers opening outward in a radial direction of the printing cylinder, and a masking sheet member configured to cover opening portions of the plurality of suction chambers and including a plurality of through holes, the masking sheet member including a non-sucking portion which extends along a boundary of the plurality of suction chambers and protrudes from the boundary of the plurality of suction chambers toward the inside of the plurality of suction chambers, and the plurality of through holes being formed in a portion except for the non-sucking portion in the masking sheet member, an air suction device connected to the plurality of suction chambers and configured to selectively suck air from the plurality of suction chambers, and an ink device configured to transfer ink to the sheet sucked to the printing cylinder.

DESCRIPTION OF THE PREFERRED EMBODIMENT

Figure 1:
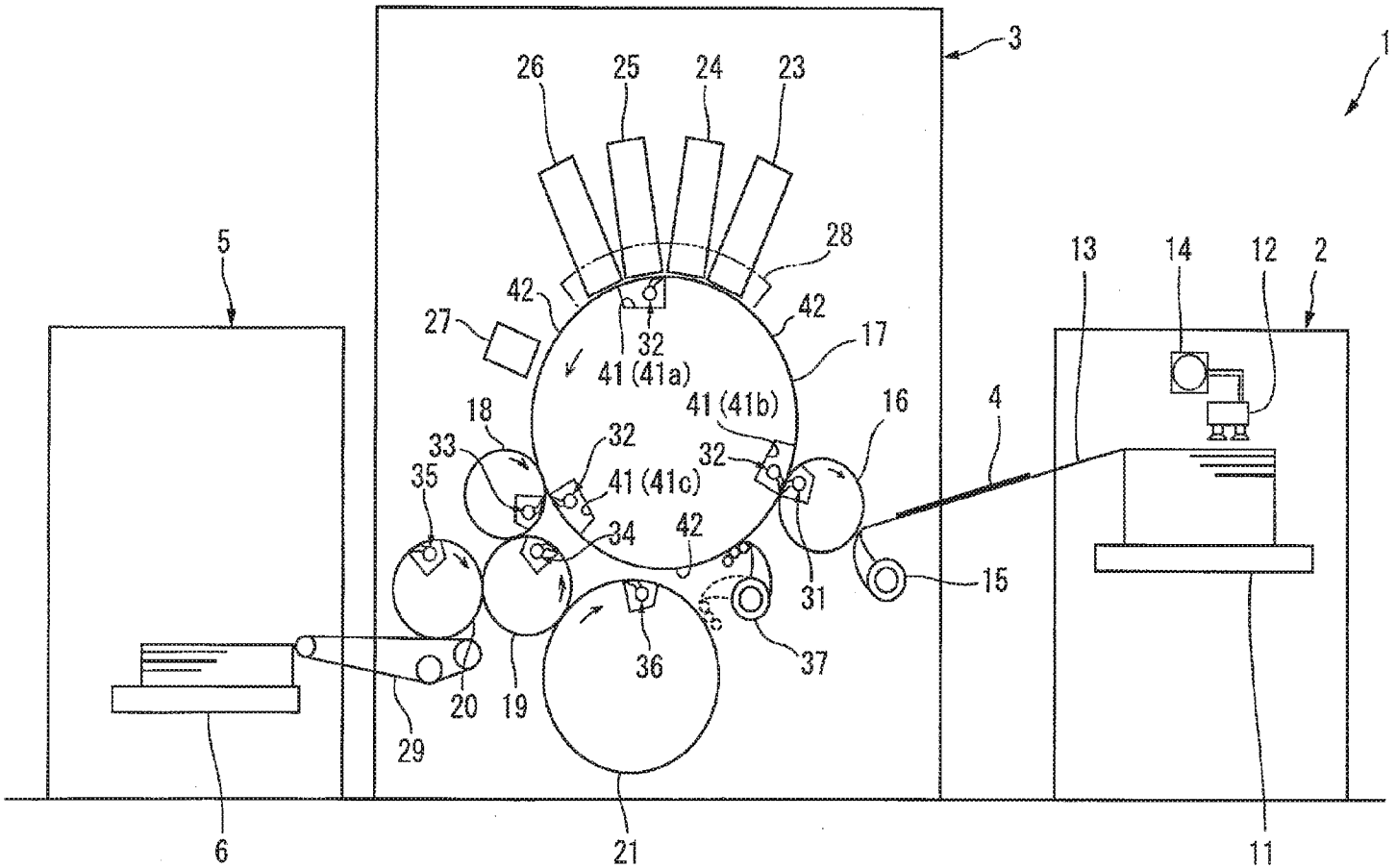
FIG. 1 is a side view showing the overall arrangement of a printing press according to an embodiment of the present invention.

An embodiment of a printing press according to the present invention will be described in detail below with reference to FIGS. 1 to 6. A printing press 1 shown in FIG. 1 conveys a sheet 4 as a printing product from a feeder unit 2 positioned at the rightmost position in FIG. 1 to a printing unit 3, and the printing unit 3 prints on one or two surfaces of the sheet 4. The sheet 4 printed by the printing unit 3 is fed to a delivery unit 5, and delivered to a delivery pile 6.

The feeder unit 2 has a structure of transferring the sheet 4 from a feeder pile 11 to a feeder board 13 by a sucker 12. The sucker 12 is connected to an intermittent sheet feed valve 14, and operates in one of a mode in which the sheets 4 are successively fed and a mode in which the sheets 4 are intermittently fed. If only the obverse surface of each sheet 4 is printed, the sucker 12 successively feeds the sheets 4 to the feeder board 13. On the other hand, if the obverse and reverse surfaces of each sheet 4 are printed, the sucker 12 intermittently feeds the sheets 4 to the feeder board 13.

The printing unit 3 includes a feed-side transfer cylinder 16 to which the sheet 4 fed from the feeder unit 2 is conveyed by a sheet feed-side swing device 15, a printing cylinder 17 to which the sheet 4 is fed from the feed-side transfer cylinder 16, and a plurality of transport cylinders 18 to 21 for feeding the printed sheet 4. The feed-side transfer cylinder 16 includes a heater (not shown) for heating the sheet 4 to a predetermined temperature. The printing cylinder 17 sucks and conveys the sheet 4, and includes part of a sucking device 22 (see FIG. 2) (to be described later).

The printing unit 3 includes first to fourth inkjet heads 23 to 26 which oppose the printing cylinder 17 and are positioned on the downstream side of the feed-side transfer cylinder 16 in the sheet convey direction. The first to fourth inkjet heads 23 to 26 execute printing by discharging ink droplets to the sheet 4 sucked to the printing cylinder 17 and transferring ink. In this embodiment, the first to fourth inkjet heads 23 to 26 form an "ink device" according to the present invention. Note that the number of inkjet heads is not limited to four. In the first to fourth inkjet heads 23 to 26, since piezoelectric elements (not shown) vibrate at a high speed at the time of discharging ink droplets, an ink mist is generated in addition to the ink droplets used for printing. The first to fourth inkjet heads 23 to 26 according to this embodiment include a mist catcher 28 to prevent the ink mist from being scattered toward the printing cylinder 17. The mist catcher 28 sucks the ink mist near the first to fourth inkjet heads 23 to 26.

The printing unit 3 further includes an ink drying lamp 27 which opposes the printing cylinder 17 and is positioned on the downstream side of the fourth inkjet head 26 in the convey direction. The ink drying lamp 27 dries (cures) printed ink which has been applied to the sheet 4 by the first to fourth inkjet heads 23 to 26.

The above-described plurality of transport cylinders include the first delivery-side transfer cylinder 18 for receiving the sheet 4 from the printing cylinder 17, the second delivery-side transfer cylinder 19 for receiving the sheet 4 from the first delivery-side transfer cylinder 18, and the third delivery-side transfer cylinder 20 and pre-converting double-size cylinder 21 for receiving the sheet 4 from the second delivery-side transfer cylinder 19. The sheet 4 whose reverse surface is printed is conveyed from the second delivery-side transfer cylinder 19 to the pre-converting double-size cylinder 21. The sheet 4 whose obverse surface is printed or the sheet 4 whose obverse and reverse surfaces are printed is fed from the second delivery-side transfer cylinder 19 to the third delivery-side transfer cylinder 20, and then fed to the delivery pile 6 via a delivery belt 29.

The feed-side transfer cylinder 16, printing cylinder 17, first delivery-side transfer cylinder 18, second delivery-side transfer cylinder 19, third delivery-side transfer cylinder 20, and pre-converting double-size cylinder 21 include gripper devices 31 to 36 for transferring the sheet 4, respectively. These gripper devices 31 to 36 have a conventionally known structure of gripping and holding the downstream end portion of the sheet 4 in the convey direction.

A convertible swing device 37 for feeding the sheet 4 from the pre-converting double-size cylinder 21 to the printing cylinder 17 is arranged between the pre-converting double-size cylinder 21 and the feed-side transfer cylinder 16. The convertible swing device 37 grips the upstream end portion of the sheet 4 in the convey direction, which has been fed by the pre-converting double-size cylinder 21, and feeds the sheet 4 to the printing cylinder 17 while the obverse surface of the sheet 4 opposes the printing cylinder 17.

The outer portion of the printing cylinder 17 is formed by three gaps 41 (41*a* to 41*c*) each accommodating the gripper device 32, and three sheet support portions 42 each for sucking and holding the sheet 4. The three gaps 41 are formed at positions spaced apart from each other in the circumferential direction in the outer surface of the printing cylinder 17. More precisely, the three gaps 41 are formed at positions which divide the outer surface into three parts in the circumferential direction. Although details will be described later, the three sheet support portions 42 are formed between the gaps 41. That is, the printing cylinder 17 is a triple-size cylinder including three pairs of gaps 41 and sheet support portions 42.

Figure 2:
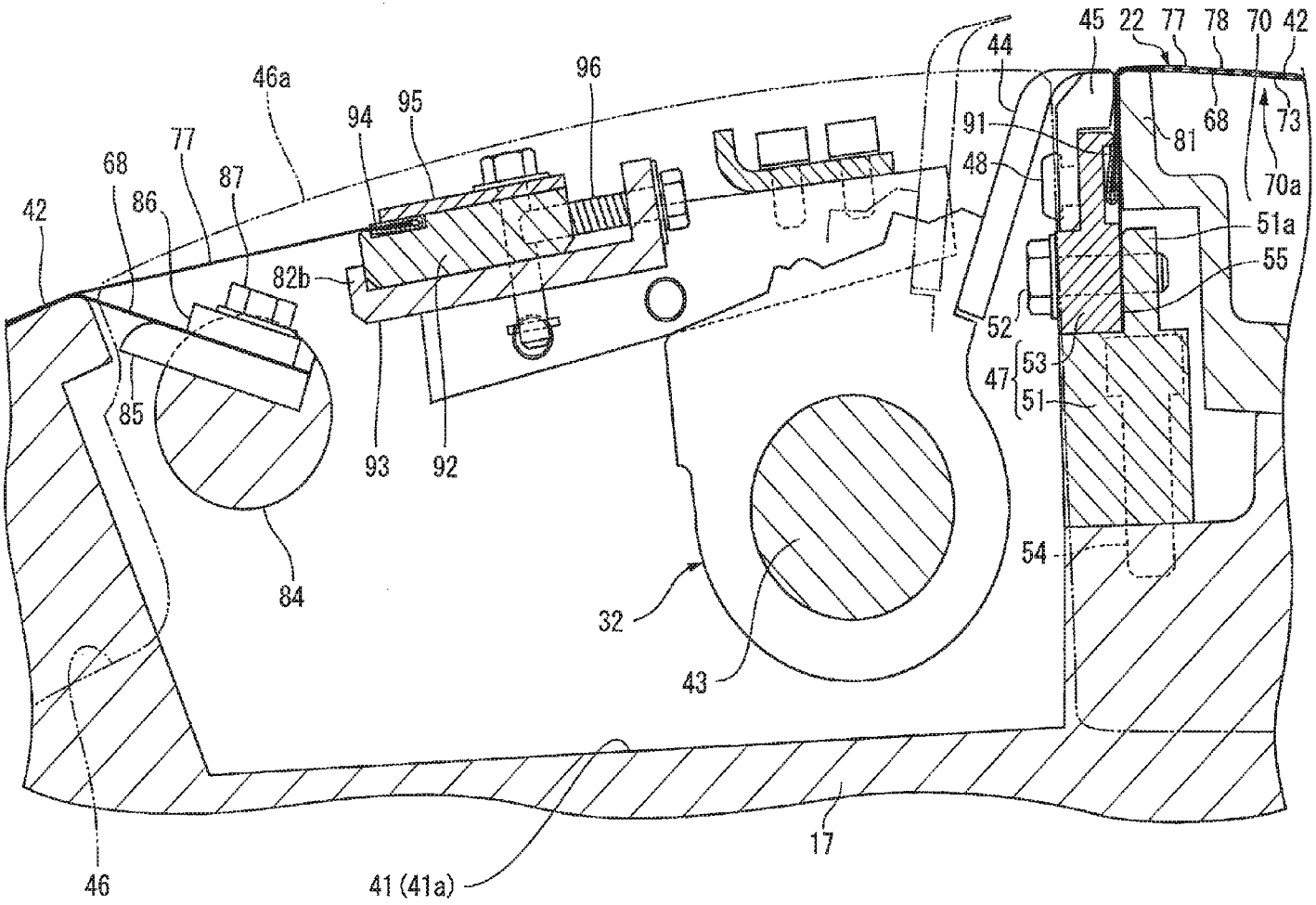
FIG. 2 is an enlarged sectional view showing a gap formed in an outer surface of a printing cylinder.

As shown in FIG. 2, each gripper device 32 of the printing cylinder 17 is formed by a gripper shaft 43, a gripper member 44 disposed in the gripper shaft 43, a gripper pad 45 for sandwiching the sheet 4 in cooperation with the gripper member 44, and the like. The gripper shaft 43, gripper member 44, and gripper pad 45 are disposed in the gap 41.

The gripper shaft 43 extends from one end portion of the printing cylinder 17 to the other end portion in the axial direction in parallel to the axis (rotation axis) of the printing cylinder 17, and is rotatably supported by support plate members 46*a* of support plates 46 attached to the two end portions of the printing cylinder 17. Each support plate member 46*a* is a portion which is formed in the outer portion of the support plate 46 to protrude outward in the radial direction, and is disposed at each of three positions, in the circumferential direction, corresponding to the gaps 41. Each support plate member 46*a* is formed in a shape to cover the corresponding gap 41 from the outside of the printing cylinder 17 in the axial direction. The gripper shaft 43 is driven by a conventionally well-known cam mechanism (not shown), and pivots at a predetermined time.

The gripper member 44 is disposed at each of a plurality of positions in the axial direction of the corresponding gripper shaft 43. The gripper member 44 moves between a gripping position indicated by solid lines in FIG. 2 and a release position indicated by two-dot dashed lines in FIG. 2 when the gripper shaft 43 pivots. The gripper pad 45 is fixed by a fixing bolt 48 while it is placed on the distal end portion of a gripper pad shaft 47 attached to the gap 41.

In this embodiment, the gripper pad shaft 47 is formed by a support member 51 which protrudes outward in the radial direction of the printing cylinder 17 from the bottom of the gap 41, and a holding member 53 which is fixed by a fixing bolt 52 while it is overlaid on a protruded end portion 51*a* of the support member 51. The support member 51 and the holding member 53 extend from one end portion of the printing cylinder 17 to the other end portion in the axial direction in parallel to the axis of the printing cylinder 17. The support member 51 is fixed to the bottom of the gap 41 by a fixing bolt 54. An abutting surface 55 between the holding member 53 and the protruded end portion 51*a* of the support member 51 extends in the radial and axial directions of the printing cylinder 17.

Figure 3:
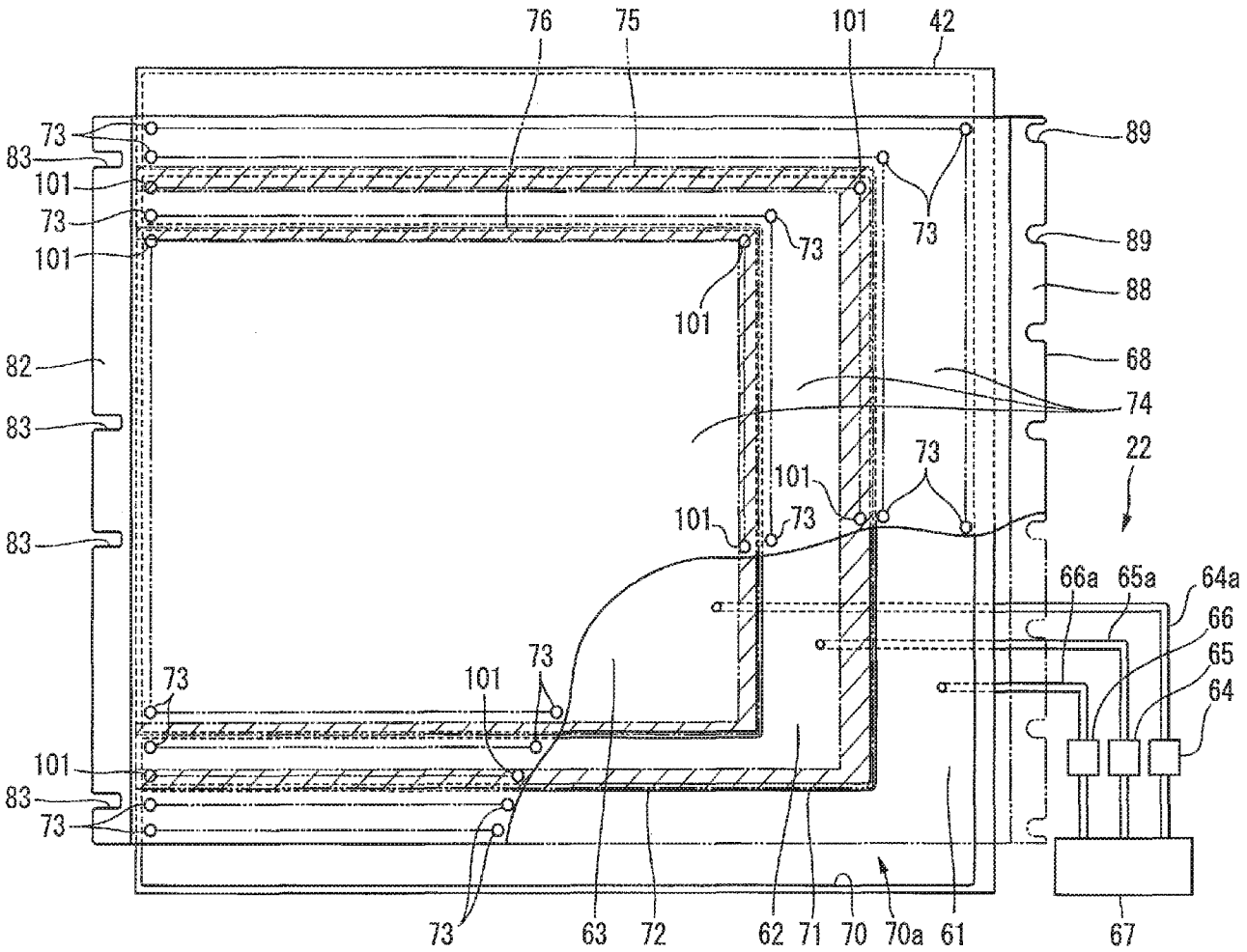
FIG. 3 is an exploded plan view showing a sheet support portion of the printing cylinder by partially cutting away a masking sheet.

As shown in FIG. 3, a concave portion 70 having a rectangular planar shape is formed in each of the three sheet support portions 42 of the printing cylinder 17. The concave portion 70 includes an opening portion 70*a* on the outer surface of the printing cylinder 17. First and second partitions 71 and 72 extending in the radial direction of the printing cylinder 17 stand from the bottom of the concave portion 70. Each of the first and second partitions 71 and 72 extends in the upstream direction of the sheet convey direction from the wall of the concave portion 70 on the downstream side in the sheet convey direction (one of the walls of the concave portion 70 in the circumferential direction of the printing cylinder 17), is folded in the axial direction of the printing cylinder 17, is further folded in the downstream direction of the sheet convey direction, and reaches the wall of the concave portion 70 on the downstream side in the sheet convey direction. Therefore, each of the first and second partitions 71 and 72 has a planar shape to form a rectangle with the wall of the concave portion 70 on the downstream side in the sheet convey direction. The first and second partitions 71 and 72 are arranged in the concave portion 70 to have a nested structure. The first partition 71 is arranged outside and the second partition 71 is arranged inside. By partitioning the interior of the concave portion 70 by the first and second partitions 71 and 72, first to third suction chambers 61 to 63 having a nested structure are formed.

The first to third suction chambers 61 to 63 open outward in the radial direction of the printing cylinder 17. Each of the first to third suction chambers 61 to 63 has a planar shape according to the outer shape of each of the plurality of types of sheets 4 having different sizes. More specifically, the first suction chamber 61 is formed in a shape similar to (or conforming to) the outer shape of the large-size sheet 4 (not shown). The second suction chamber 62 is formed in a shape similar to (or conforming to) the outer shape of the medium-size sheet 4 (not shown). The second suction chamber 62 is formed in the first suction chamber 61, and partitioned from the first suction chamber 61 by the first partition 71. That is, the first partition 71 serves as the boundary of the first suction chamber 61 and the second suction chamber 62. The third suction chamber 63 is formed in a shape similar to (or conforming to) the outer shape of the small-size sheet 4 (not shown). The third suction chamber 63 is formed in the second suction chamber 62, and partitioned from the second suction chamber 62 by the second partition 72. That is, the second partition 72 serves as the boundary of the second suction chamber 62 and the third suction chamber 63. The downstream end portions (left end portions in FIG. 3) of the first to third suction chambers 61 to 63 in the sheet convey direction are formed at the same position in the sheet convey direction.

The first to third suction chambers 61 to 63 are connected to an air suction device 67 by first to third pipes 64*a* to 66*a*, respectively. First to third opening/closing valves 64 to 66 are provided in the first to third pipes 64*a* to 66*a*, respectively. The first to third opening/closing valves 64 to 66 individually switch between an open state in which the first to third suction chambers 61 to 63 communicate with the air suction device 67 and a closed state in which communication between the air suction device 67 and the first to third suction chambers 61 to 63 is interrupted.

The air suction device 67 sucks air in the first to third suction chambers 61 to 63 via the first to third opening/closing valves 64 to 66, respectively. Air is sucked in a suction chamber connected to an opening/closing valve in the open state among the first to third opening/closing valves 64 to 66. That is, the air suction device 67 selectively sucks air from the suction chambers 61 to 63.

Figure 4:
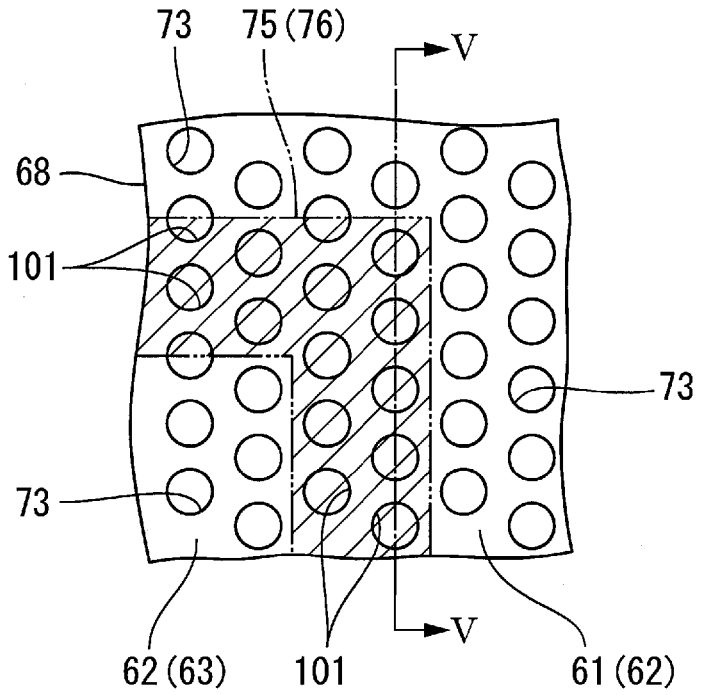
FIG. 4 is an enlarged plan view showing part of the masking sheet.

The opening portions of the first to third suction chambers 61 to 63 (the opening portion 70*a* of the concave portion 70) are covered with a masking sheet 68. The masking sheet 68 is formed by a sheet made of stainless steel. Although details will be described later, the masking sheet 68 includes a sucking portion 74 in which a number (a plurality) of through holes 73 are formed, and first and second non-sucking portions 75 and 76 in which no through holes 73 are formed. Referring to FIGS. 3 and 4, the first and second non-sucking portions 75 and 76 are hatched. The masking sheet 68 is fixed to the sheet support portion 42 while it is overlaid on the opening ends of the first to third suction chambers 61 to 63. In this embodiment, the masking sheet 68 forms a "masking sheet member" according to the present invention. A perforated resin sheet 77 (see FIG. 2) is overlaid on the outside of the masking sheet 68. In the perforated resin sheet 77 as well, a number (a plurality) of through holes 78 are formed, similarly to the through holes 73 of the masking sheet 68.

The masking sheet 68 and the perforated resin sheet 77 are fixed in the two end portions in the sheet convey direction. In the gap 41 (41*a*) shown in FIG. 2, the downstream end portion of the masking sheet 68 in the sheet convey direction is folded inside in the radial direction of the printing cylinder 17 along a vertical wall 81 of the first to third suction chambers 61 to 63, and sandwiched by the holding member 53 and the protruded end portion 51*a* of the support member 51, which have been described above. The end portion (the downstream end portion in the sheet convey direction) of the masking sheet 68 sandwiched by the protruded end portion 51*a* and the holding member 53 includes a first plate-like portion 82 where no through holes 73 are formed, as shown in FIG. 3. In the first plate-like portion 82, a plurality of outer notches 83 through which the fixing bolt 52 extends are formed. Each of the outer notches 83 is formed in a shape in which the fixing bolt 52 fits, and has a function of determining the position of the masking sheet 68. The position of the masking sheet 68 indicates that with respect to the printing cylinder 17 in the sheet convey direction and the axial direction of the printing cylinder 17.

The upstream end portion (the other end portion) of the masking sheet 68 in the sheet convey direction is fixed to a sheet holding shaft 84 disposed in the gap 41 (41*b*) separated from the gap 41 (41*a*) shown in FIG. 2 on the upstream side in the sheet convey direction. More specifically, the other end portion of the masking sheet 68 is sandwiched by a pair of plates 85 and 86, and fixed to the sheet holding shaft 84 by a fixing bolt 87 together with the plates 85 and 86. As shown in FIG. 3, the end portion of the masking sheet 68 sandwiched by the plates 85 and 86 includes a second plate-like portion 88 where no through holes 73 are formed. In the second plate-like portion 88, a plurality of outer notches 89 through which the fixing bolt 87 extends are formed. Each of the outer notches 89 has a function of determining the position of the masking sheet 68.

The other end portion of the masking sheet 68 is pulled when the sheet holding shaft 84 rotates clockwise in FIG. 2. The masking sheet 68 is attached to the sheet support portion 42 while the other end portion is pulled in this way to generate a predetermined tension. Note that the sheet holding shaft 84 shown in FIG. 2 does not support the masking sheet 68 covering the sheet support portion 42 positioned on the right side in FIG. 2. The sheet holding shaft 84 shown in FIG. 2 supports the end portion of the masking sheet 68 covering the sheet support portion 42 between the gap 41 (41*a*) and the gap 41 (41*c*) separated on the downstream side.

Figure 6:
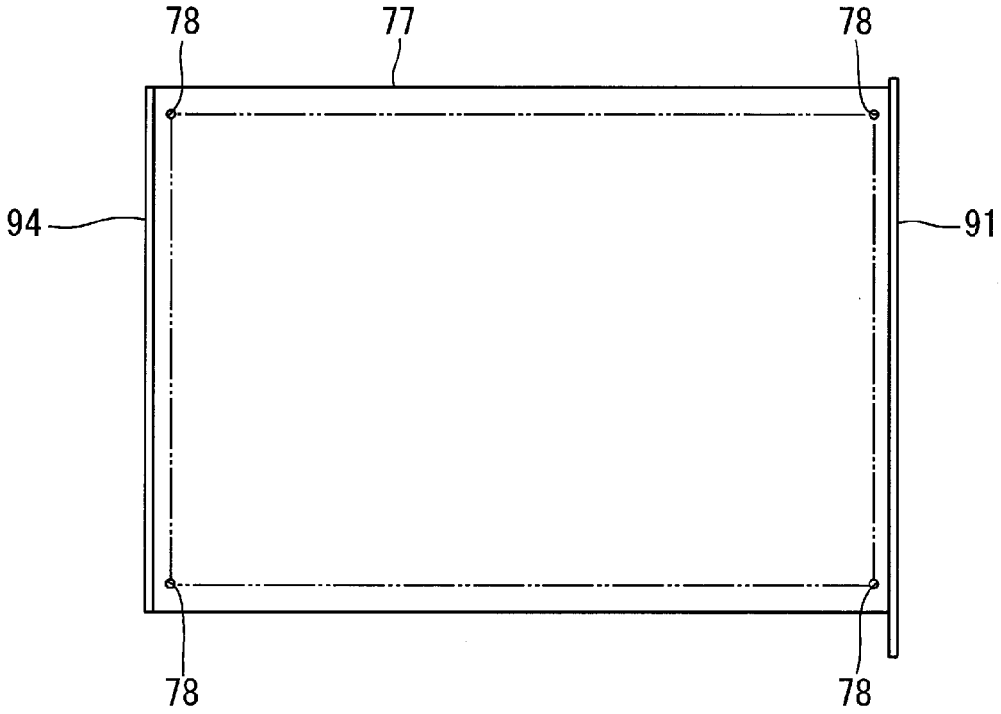
FIG. 6 is a plan view showing a perforated resin sheet.

One end portion (the downstream end portion in the sheet convey direction) of the perforated resin sheet 77 is folded inside in the radial direction of the printing cylinder 17 along the above-described vertical wall 81 in the gap 41 (41*a*) shown in FIG. 2, and inserted between the holding member 53 and the vertical wall 81. A first base 91 is disposed in one end portion of the perforated resin sheet 77, as shown in FIG. 6. The first base 91 is engaged with the holding member 53. Consequently, even if the perforated resin sheet 77 is pulled toward the other end portion, the movement of the first base 91 is restricted by the holding member 53, and thus one end portion of the perforated resin sheet 77 is never removed from the printing cylinder 17.

The other end portion (upstream end portion in the sheet convey direction) of the perforated resin sheet 77 is fixed to a slider 92 disposed in the gap 41 (41*b*) separated from the gap 41 (41*a*) shown in FIG. 2 on the upstream side in the sheet convey direction. The slider 92 is fixed to the printing cylinder 17 via a guide member 93 extending in the axial direction of the printing cylinder 17 in the gap 41 (41*b*). As shown in FIG. 6, a second base 94 is disposed in the other end portion of the perforated resin sheet 77. The second base 94 is sandwiched by the slider 92 and a cover plate 95 while it is engaged with the slider 92. The slider 92 moves to the upstream side in the sheet convey direction by tightening an adjusting bolt 96. When the slider 92 moves, the other end portion of the perforated resin sheet 77 is pulled. The perforated resin sheet 77 is fixed to the printing cylinder 17 while a predetermined tension is generated.

Figure 5:
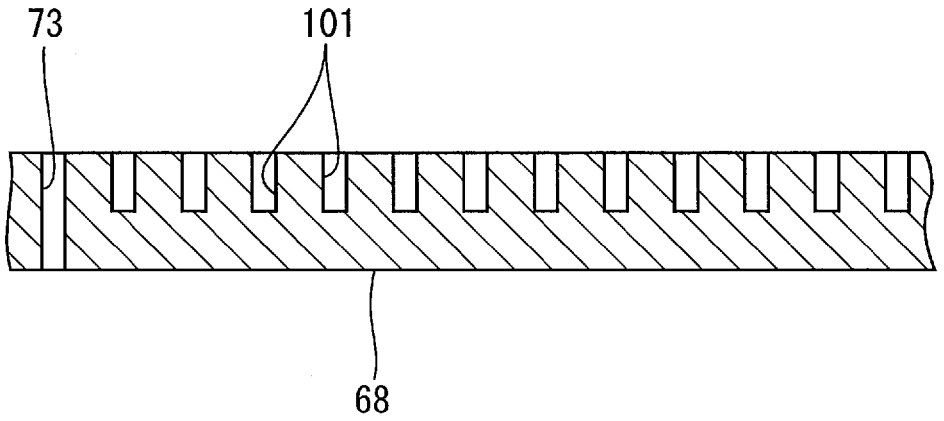
FIG. 5 is a sectional view taken along a line V-V in FIG. 4.

As described above, a number of through holes 73 are formed in the sucking portion 74 of the masking sheet 68. In other words, a number of through holes 73 are formed in a portion except for the first and second non-sucking portions 75 and 76. These through holes 73 communicate with a space near the outer surface of the printing cylinder 17 via the through holes 78 of the perforated resin sheet 77. In this embodiment, as shown in FIG. 4, the through holes 73 are formed at predetermined intervals in the masking sheet 68 in the axial direction (upper-and-lower direction in FIG. 4) of the printing cylinder 17 and in the sheet convey direction (right-and-left direction in FIG. 4). The opening shape of each through hole 73 is a circle. As shown in FIG. 5, each through hole 73 extends through the masking sheet 68 in the thickness direction. In this embodiment, the thickness of the masking sheet 68 is about 1 mm. The diameter of each through hole 73 is equal to or smaller than 0.3 mm.

The first and second non-sucking portions 75 and 76 of the masking sheet 68 are used to change the positions of the substantial opening edges of the second and third suction chambers 62 and 63 in a direction in which the opening widths become narrower. The first non-sucking portion 75 extends along the first partition 71 serving as the boundary of the first suction chamber 61 and the second suction chamber 62, and protrudes from a position opposing the first partition 71 toward the inside of the second suction chamber 62. In other words, the first non-sucking portion 75 is formed in a shape which extends inside the second suction chamber 62 from the position opposing the first partition 71 by a predetermined width. Thus, the substantial opening width (the width in the axial direction of the printing cylinder 17 and the width in the sheet convey direction) of the second suction chamber 62 becomes narrower by the width of the first non-sucking portion 75. The second non-sucking portion 76 extends along the second partition 72 serving as the boundary of the second suction chamber 62 and the third suction chamber 63, and protrudes from a position opposing the second partition 72 toward the inside of the third suction chamber 63. In other words, the second non-sucking portion 76 is formed in a shape which extends inside the third suction chamber 63 from the position opposing the second partition 72 by a predetermined width. Thus, the substantial opening width of the third suction chamber 63 becomes narrower by the width of the second non-sucking portion 76.

The widths of the first and second non-sucking portions 75 and 76 are set based on the size of the sheet 4 to be printed. If the sheet 4 having a size smaller than the outer portion (first partition 71) of the opening portion of the second suction chamber 62 and larger than the outer portion (second partition 72) of the opening portion of the third suction chamber 63 is used, the width of the first non-sucking portion 75 corresponds to the distance between the sheet 4 and the first partition 71. If the sheet 4 having a size smaller than the outer portion (second partition 72) of the opening portion of the third suction chamber 63 is used, the width of the second non-sucking portion 76 corresponds to the distance between the sheet 4 and the second partition 72.

The first and second non-sucking portions 75 and 76 are half-etched to form a number (a plurality) of non-through holes (bottomed holes) 101 which have the same diameter as that of the through holes 73 and never extend through the masking sheet 68, as shown in FIG. 5. The non-through holes 101 according to this embodiment are formed as concave portions having a circular opening shape by etching the masking sheet 68.

The above-described first to third suction chambers 61 to 63, the air suction device 67 connected to the first to third suction chambers 61 to 63 via the opening/closing valves 64 to 66, respectively, the masking sheet 68 forming part of the outer surface of the printing cylinder 17, and the like constitute the sucking device 22 for sucking, toward the outer surface of the printing cylinder 17, the sheet 4 conveyed by the printing cylinder 17.

The printing press 1 having the above arrangement is operated while the sucking device 22 of the printing cylinder 17 is operated. If the air suction device 67 operates by setting all the first to third opening/closing valves 64 to 66 of the sucking device 22 in the open state, air is inhaled, as sucking air, into the first to third suction chambers 61 to 63 by passing through the through holes 78 of the perforated resin sheet 77 and the through holes 73 of the masking sheet 68. When the sucking air passes through the through holes 73 and 78, the sheet 4 held by the gripper device 32 and overlaid on the sheet support portion 42 is sucked to the sheet support portion 42 (perforated resin sheet 77). At this time, the first and second non-sucking portions 75 and 76 block the sucking air.

To suck the sheet 4, a smallest suction chamber with an opening wider than the sheet 4 is used. For example, when printing on the sheet 4 smaller than the second suction chamber 62 and larger than the third suction chamber 63, the second suction chamber 62 and the third suction chamber 63 are used and the use of the first suction chamber 61 is stopped. The substantial opening edge of the second suction chamber 62 is determined by the first non-sucking portion 75 of the masking sheet 68, and is set at a position shifted to the inside of the second suction chamber 62 with reference to the position of the actual opening edge. When printing on the sheet 4 smaller than the actual opening width of the second suction chamber 62, the first non-sucking portion 75 is positioned between the sheet 4 and the first partition 71 (the actual opening edge of the second suction chamber 62), and thus no through holes 73 exist or the minimum number of through holes 73 exist. Therefore, according to this embodiment, the simple arrangement in which the first and second non-sucking portions 75 and 76 are formed in the masking sheet 68 can prevent air from being sucked outside a range where the sheet 4 is sucked. As a result, it is possible to provide the printing press which includes the printing cylinder 17 for sucking and conveying the sheet 4 but can prevent an ink mist from adhering to the printing cylinder 17 with the simple arrangement.

In this embodiment, in the first and second non-sucking portions 75 and 76 of the masking sheet 68, a number of non-through holes 101 having the same diameter as that of the through holes 73 are formed. Therefore, the heat conductivity of the sucking portion 74, having the through holes 73, of the masking sheet 68 and those of the first and second non-sucking portions 75 and 76 are not largely different, thereby obtaining almost the same heat conductivity over the entire formation range of the masking sheet 68. According to this embodiment, the heat distribution of the sheet 4 sucked to the printing cylinder 17 is uniform, thereby executing printing more satisfactorily.

The two end portions of the masking sheet 68 are detachably attached to the printing cylinder 17 using the fixing bolts 52 and 87. If the size of the sheet 4 to be printed by the destination of the printing press 1 is different, it is possible to replace the masking sheet 68 by that corresponding to the size of the sheet 4. Even the destination which prints the sheet 4 having a different size can prevent air from being sucked from the outside of the sheet 4 without changing the arrangement of the first to third suction chambers 61 to 63.

This embodiment has explained an example in which the masking sheet 68 made of stainless steel is used. The material of the masking sheet 68 is not limited to stainless steel. For example, the masking sheet 68 can be made of an aluminum alloy. Alternatively, the masking sheet 68 can be formed using a synthetic resin material as long as it can satisfy strength and heat resistance requirements.

The above-described embodiment has exemplified an example in which the first to third suction chambers 61 to 63 are provided in the sheet support portion 42. However, the shape and number of suction chambers provided in the sheet support portion 42 are not limited to those in this embodiment, and can be changed appropriately.

What is claimed is:

1. A printing press comprising:

a printing cylinder configured to suck and convey a sheet as a printing product, and including a plurality of suction chambers opening outward in a radial direction of the printing cylinder, and a masking sheet member arranged outward in the radial direction of the printing cylinder relative to the plurality of suction chambers, configured to cover opening portions of the plurality of suction chambers and including a plurality of through holes, the masking sheet member including a non-sucking portion which extends along a boundary of the plurality of suction chambers and protrudes from the boundary of the plurality of suction chambers toward the inside of the plurality of suction chambers, and the plurality of through holes being formed in a portion except for the non-sucking portion in the masking sheet member and being positioned face-to-face with the plurality of suction chambers;

an air suction device connected to the plurality of suction chambers and configured to selectively suck air from the plurality of suction chambers; and an ink device configured to transfer ink to the sheet sucked to the printing cylinder.

2. The printing press according to claim 1, wherein the masking sheet member includes a plurality of non-through holes formed in the non-sucking portion and having the same diameter as that of the through holes.

3. The printing press according to claim 1, wherein each of the plurality of suction chambers has a planar shape according to an outer shape of each of a plurality of types of sheets having different sizes.

4. The printing press according to claim 1, wherein the printing cylinder includes a concave portion opening on an outer surface of the printing cylinder, and a partition wall extending in the radial direction of the printing cylinder from a bottom of the concave portion and forming the plurality of suction chambers by partitioning the inside of the concave portion.

5. The printing press according to claim 4, wherein the partition wall has a planar shape which forms a rectangle with one of walls of the concave portion in a circumferential direction of the printing cylinder.

6. The printing press according to claim 4, wherein the partition wall includes a plurality of walls arranged in the concave portion to have a nested structure.

7. The printing press according to claim 1, further comprising:

a plurality of pipes connecting the air suction device and the plurality of suction chambers, respectively; and a plurality of opening/closing valves respectively provided in the plurality of suction chambers and configured to individually switch between an open state in which the plurality of suction chambers communicate with the air suction device and a closed state in which communication between the air suction device and the plurality of suction chambers is interrupted.

* * * * *